US012440018B2

(12) United States Patent
Mironski

(10) Patent No.: US 12,440,018 B2
(45) Date of Patent: Oct. 14, 2025

(54) MODULAR ATTACHMENT LOAD SYSTEM

(71) Applicant: Tomasz B. Mironski, Cameron, NC (US)

(72) Inventor: Tomasz B. Mironski, Cameron, NC (US)

( * ) Notice: Subject to any disclaimer, the term of this patent is extended or adjusted under 35 U.S.C. 154(b) by 140 days.

(21) Appl. No.: 18/296,668

(22) Filed: Apr. 6, 2023

(65) Prior Publication Data

US 2024/0130512 A1 Apr. 25, 2024
US 2024/0225250 A9 Jul. 11, 2024

Related U.S. Application Data

(60) Provisional application No. 63/339,116, filed on May 6, 2022.

(51) Int. Cl.
*A45F 5/02* (2006.01)

(52) U.S. Cl.
CPC ..... *A45F 5/02* (2013.01)

(58) Field of Classification Search
CPC ..... A45F 5/02
See application file for complete search history.

(56) References Cited

U.S. PATENT DOCUMENTS 4,848,624 A * 7/1989 Clem ..... A45C 7/00 224/267
5,806,740 A 9/1998 Carlson
5,833,095 A * 11/1998 Russell ..... A45F 5/02 224/684
6,237,820 B1 5/2001 Saxton
9,055,773 B2 6/2015 Crye
9,144,294 B2 9/2015 Gregory et al.
9,664,481 B2 5/2017 Alcantra et al.
9,820,556 B2 11/2017 Adams et al.
10,143,294 B1 * 12/2018 Matson ..... A45F 5/02
10,299,570 B2 5/2019 Kim et al.
10,555,598 B2 2/2020 Evans et al.
10,555,599 B2 2/2020 Becker
10,765,196 B1 * 9/2020 Thompson ..... A45C 3/00
10,905,226 B2 2/2021 Cole et al.
10,928,172 B1 2/2021 Mironski
11,025,075 B2 6/2021 Thiel et al.
11,425,986 B2 8/2022 Postolek
(Continued)

FOREIGN PATENT DOCUMENTS

GB 2491624 A 12/2012

OTHER PUBLICATIONS

European Search Report; 24000034.9; Dated Jul. 22, 2024.

*Primary Examiner* — Brian D Nash
(74) *Attorney, Agent, or Firm* — Dunlap Bennett & Ludwig, PLLC; Anna L. Kinney

(57) ABSTRACT

A modular attachment load system includes a substrate having multiple spaced apart holes; a binding material; and an article having spaced apart holes aligned with a portion of the substrate's holes. A method of using the system includes securing an end of the binding material to the substrate; positioning the article against the substrate; threading the binding material through one of the articles' holes; threading the binding material alternately through the substrate's holes and the article's holes; and securing a second end of the binding material to the substrate.

5 Claims, 15 Drawing Sheets

(56) References Cited

U.S. PATENT DOCUMENTS

| | | | | |
|---|---|---|---|---|
| 2005/0242144 | A1* | 11/2005 | Panosian | A45F 5/02 224/684 |
| 2006/0162135 | A1* | 7/2006 | Howell | A44B 13/0052 24/442 |
| 2006/0191110 | A1* | 8/2006 | Howell | A45F 5/02 24/3.12 |
| 2007/0289045 | A1 | 12/2007 | Evans et al. | |
| 2008/0277433 | A1 | 11/2008 | Karl et al. | |
| 2009/0014602 | A1 | 1/2009 | Frost | |
| 2009/0117300 | A1 | 5/2009 | Thompson | |
| 2010/0025560 | A1* | 2/2010 | Beck | A45F 5/02 248/558 |
| 2011/0036880 | A1* | 2/2011 | Lee | A45F 5/02 224/269 |
| 2015/0189977 | A1* | 7/2015 | Thompson | A45F 5/02 24/3.7 |
| 2017/0320286 | A1 | 11/2017 | Carlson | |
| 2018/0003466 | A1 | 1/2018 | Rose et al. | |
| 2018/0049493 | A1* | 2/2018 | Graves | A45C 13/1069 |
| 2019/0000221 | A1 | 1/2019 | Yeates et al. | |
| 2022/0248835 | A1* | 8/2022 | Yeates | A45F 5/02 |
| 2024/0130512 | A1* | 4/2024 | Mironski | A45F 5/02 |
| 2024/0298785 | A1* | 9/2024 | Mironski | A45F 3/08 |

* cited by examiner

MODULAR ATTACHMENT LOAD SYSTEM

CROSS-REFERENCE TO RELATED APPLICATION

This application claims the benefit of priority of U.S. provisional application No. 63/339,116, filed May 6, 2022, the contents of which are herein incorporated by reference.

BACKGROUND OF THE INVENTION

The present invention relates to load carrying equipment and, more particularly, to a modular attachment load system.

Modular Lightweight Load-carrying Equipment (MOLLE) is the current generation of load-bearing equipment and backpacks utilized by a number of North Atlantic Treaty Organization (NATO) armed forces. The MOLLE pack's modularity is derived from the use of Pouch Attachment Ladder System (PALS) webbing as rows of heavy-duty nylon stitched onto the vest to allow for the attachment of various MOLLE-compatible pouches and accessories.

Currently, there are several types of related systems. Some of these systems attempt to secure MOLLE components with ease and minimal effort for the user but fail to meet the needs of the military, law enforcement officers (LEO), and civilians as a result. MOLLE and MOLLE components are limited to vertical attachments unless the manufacturer creates the MOLLE attachments oriented to the desired direction. Other systems attempt to minimize movement between MOLLE and MOLLE-compatible items, but these systems provide weak connections between MOLLE and MOLLE-compatible items that cause material to sag. Furthermore, when standard MOLLE is subject to stress, the attachment points do not offer stationary or static positions for mounted accessories. Still other systems profess to offer quick removal of MOLLE attachments, but also fail to meet the military's, LEO's and civilians' needs because multiple pieces of material snag on the sagging internal materials during the removal process. Users become frustrated due to the lack of speedy attachment, adjustment, and removal of items from the surface.

As can be seen, there is a need for a lightweight device that allows the user to attach items to a surface at any location and at any angle, without sagging, such that the attachment provides strength and stability. Moreover, there is a need for an efficient and fluid method of attachment, adjustment, and removal utilizing the device.

SUMMARY OF THE INVENTION

In one aspect of the present invention, a modular attachment load system comprises a substrate having a plurality of spaced apart apertures; a binding material; and an article having spaced apart apertures aligned with a portion of the plurality of spaced apart apertures.

In another aspect of the present invention, a method of using a modular attachment load system comprises securing an end of a binding material to a substrate having a first plurality of spaced apart apertures; positioning an article having a second plurality of spaced apart apertures against the substrate; threading the binding material through one of the second plurality of spaced apart apertures; threading the binding material alternately through the first plurality of spaced apart apertures and the second plurality of spaced apart apertures; and securing a second end of the binding material to the substrate.

The system relies on readily available binding materials, reducing the cost of materials and labor while providing speedy, efficient, and user-friendly attachment, adjustment, and removal process of modular attachment load system (MALS)-compatible items from a lightweight MALS surface. The inventive system may be used in any field that requires attaching objects to surfaces or to each other.

These and other features, aspects and advantages of the present invention will become better understood with reference to the following drawings, description, and claims.

DETAILED DESCRIPTION OF THE INVENTION

Figure 1:
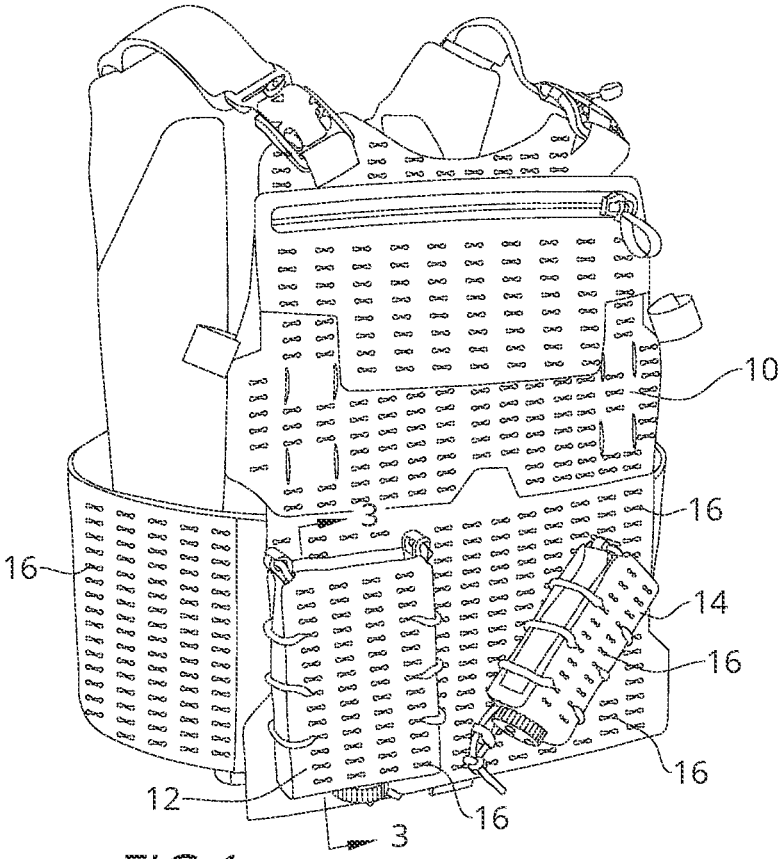
FIG. 1 is a perspective view of a modular attachment load system according to an embodiment of the present invention, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a modular attachment load system (MALS) comprising a substrate having hourglass- or teardrop-shaped apertures, for example, having a shape of an infinity symbol, operative to stably and strongly support components bound thereto in any direction and relative position.

MALS-compatible items may attach to a material at any angle and are not limited to vertical positioning as are prior art systems. Items may be mounted to the MALS surface at any angle, including horizontally and vertically, becoming fully fused to the MALS network (i.e., the mounting surface, such as a plate carrier, cummerbund, pouch, bag, or rucksack) without sagging and providing stationary status of 2 mounted items. In other words, the object being mounted and the mounting surface are joined together so securely, there is no concern that the object will unintentionally detach.

The MALS contains hourglass/teardrop shapes, holes, cuts, and/or letters referred to herein as PORTALS, which may withstand the stress of weaving material through, a single PORTAL multiple times, preventing ripping. For example, the portals may be rounded teardrop shapes, making them stronger than prior art material apertures. The binding material may be woven through, in-between, over and under, and/or adjacent to a portal or portals. PORTALS reduce the overall weight of the material.

THE MALS grid may be selected from but is not limited to a substrate or medium selected from the group consisting of: garments, non-wearable surfaces such as the back of a vehicle seat, equipment, material, plate carrier, cummerbunds, belts, pants, t-shirts, helmet covers, jackets, magazine pouches, boots, shoes, vests, backpacks, rucksacks, and any combination thereof. Garments themselves may serve as a substrate or a substrate may be attached to a garment, for example with hook-and-loop connectors.

The associated method may include but is not limited the following steps: providing a material including diversified PORTALS, asymmetrical/symmetrical/geometric/non-geometric figures, holes, cuts, and/or letters; and attaching MALS-compatible accessories through the PORTALS.

The dimensions of the MALS and PORTAL are not particularly limited. In some embodiments, the PORTALS may have a preferred diameter of about 0.23 inches (6 mm) and may be strategically spaced about 0.43 inches (11 mm) apart from left to right and about 0.31 inches (7.83 mm) apart from top to bottom on the substrate.

The disclosed device provides users the option to create connection points with one continuous strand of material or to create multiple connection points with numerous strands of materials. Materials in any range of thickness and length are readily available for consumers to mount items to the MALS surface, including cords, shoelaces, string, 550 cord, dental floss, thread, etc. A material or mixture of materials may be selected for precise use.

In some embodiments, a method of using a modular attachment load system comprises securing a single end, or multiple ends, of a binding material (such as a cord used to mount an object to the MALS) through a step selected from but not limited to the group consisting of: tie-down, tie-in, tie, stuffing, knotting, tucking, braiding, twist, spiral, warp, bending, crimping, gathering, intertwine, double over, folding, curling, hemming, corrugating, tightening, joining, hitching, linking, bracing, fastening, strapping, bonding, connecting, cord locks, toggles, branding, burnishing, melting, burning, gluing, fusing, welding, clamping, merging, etc. and any combination thereof.

The disclosed device is structurally different from prior art devices due to the presence of PORTALS having asymmetrical, symmetric, geometric, and/or non-geometric apertures. These portals enable a variety of connections between the MALS and MALS-compatible items, including prior art MOLLE-compatible items. The PORTALS are placed on the substrate and on the attachable items in such a way that the items can be attached in any direction relative to the substrate, i.e., not just vertically or horizontally, provided that the portals of the item abut the portals of the substrate, in reference to facing angles or rotation.

Figure 2:
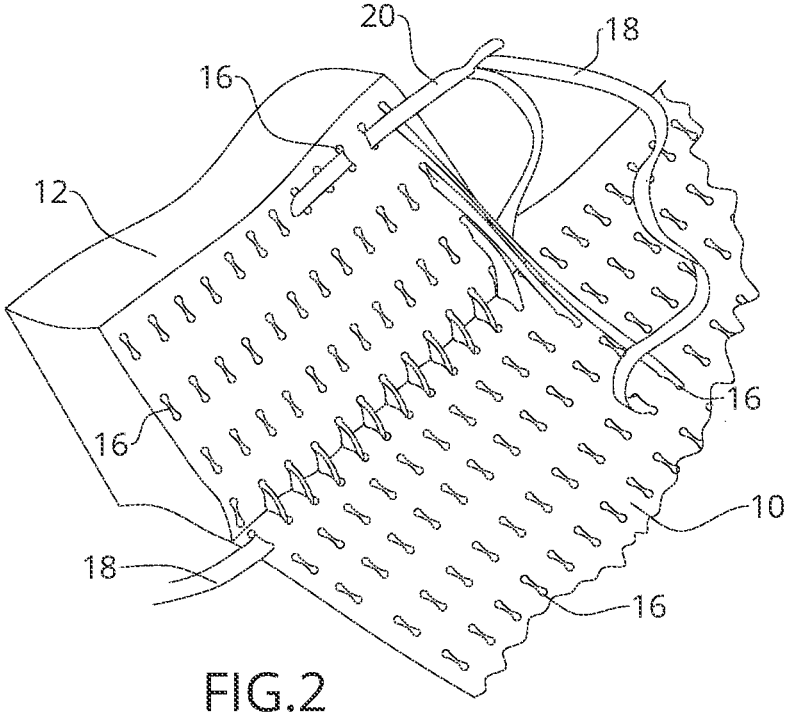
FIG. 2 is a detail perspective view thereof.
Figure 3:
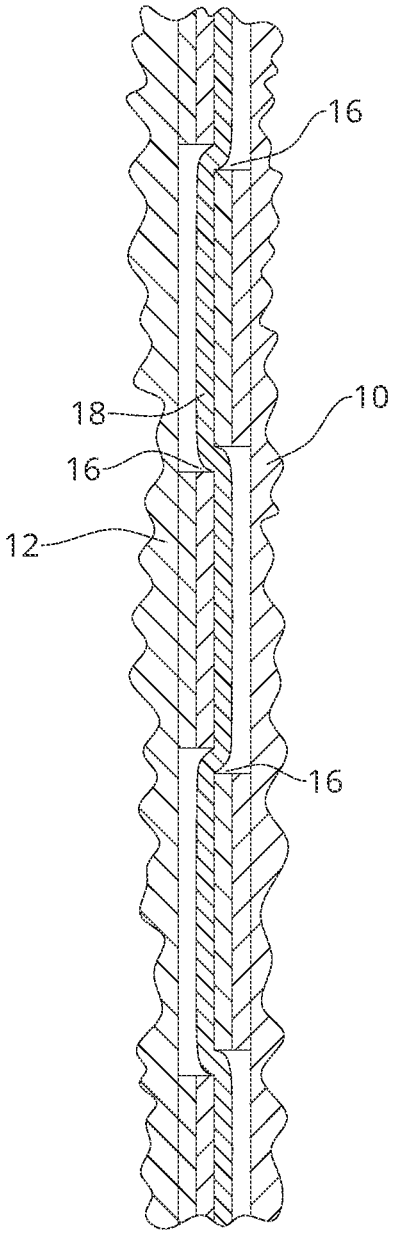
FIG. 3 is a sectional view thereof, taken along line 3-3 in FIG. 1.
Figure 4:
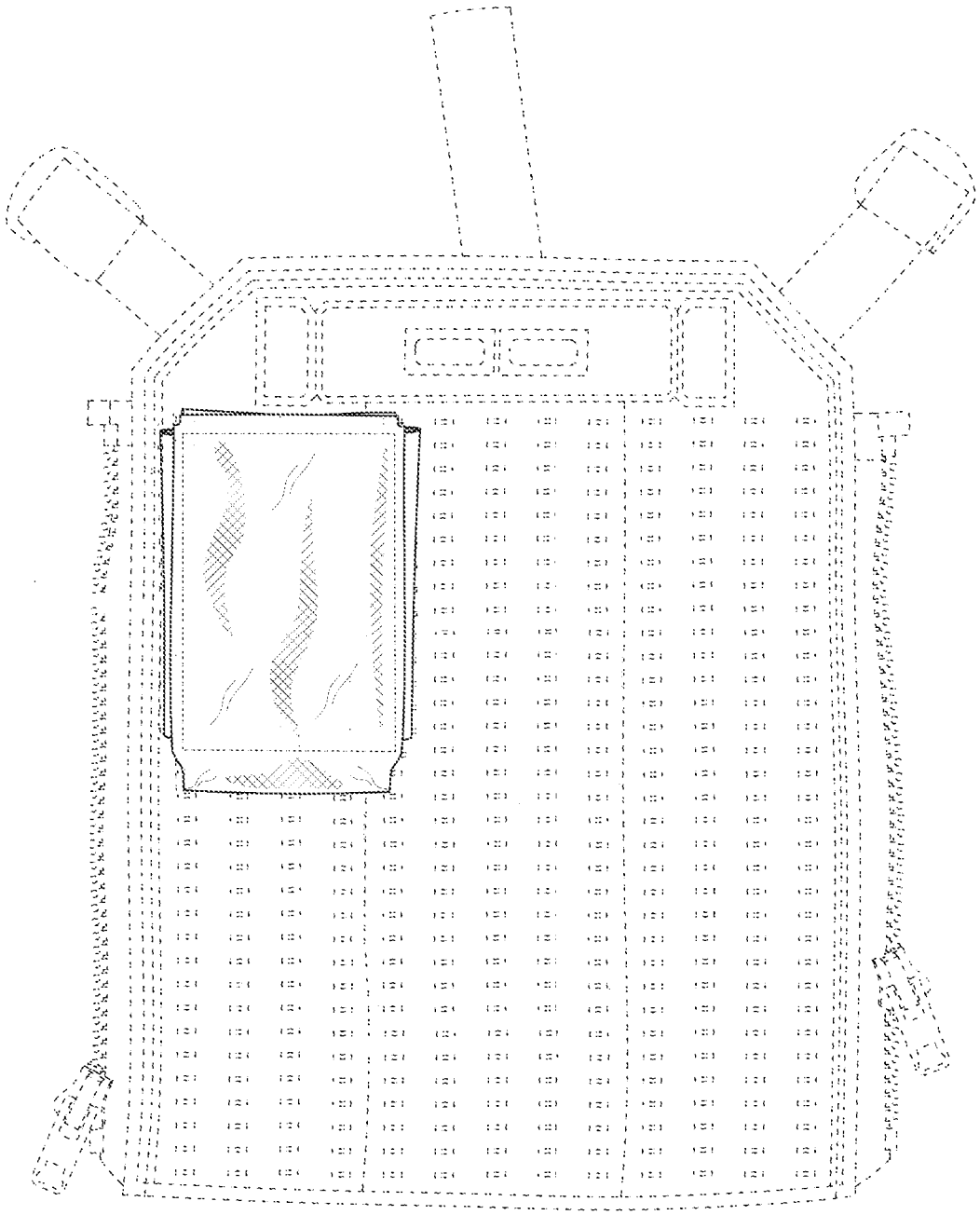
FIG. 4 is a schematic view of a modular attachment load system according to another embodiment of the present invention, with a load bearing garment shown in phantom, illustrating the versatility of the system.
Figure 5:
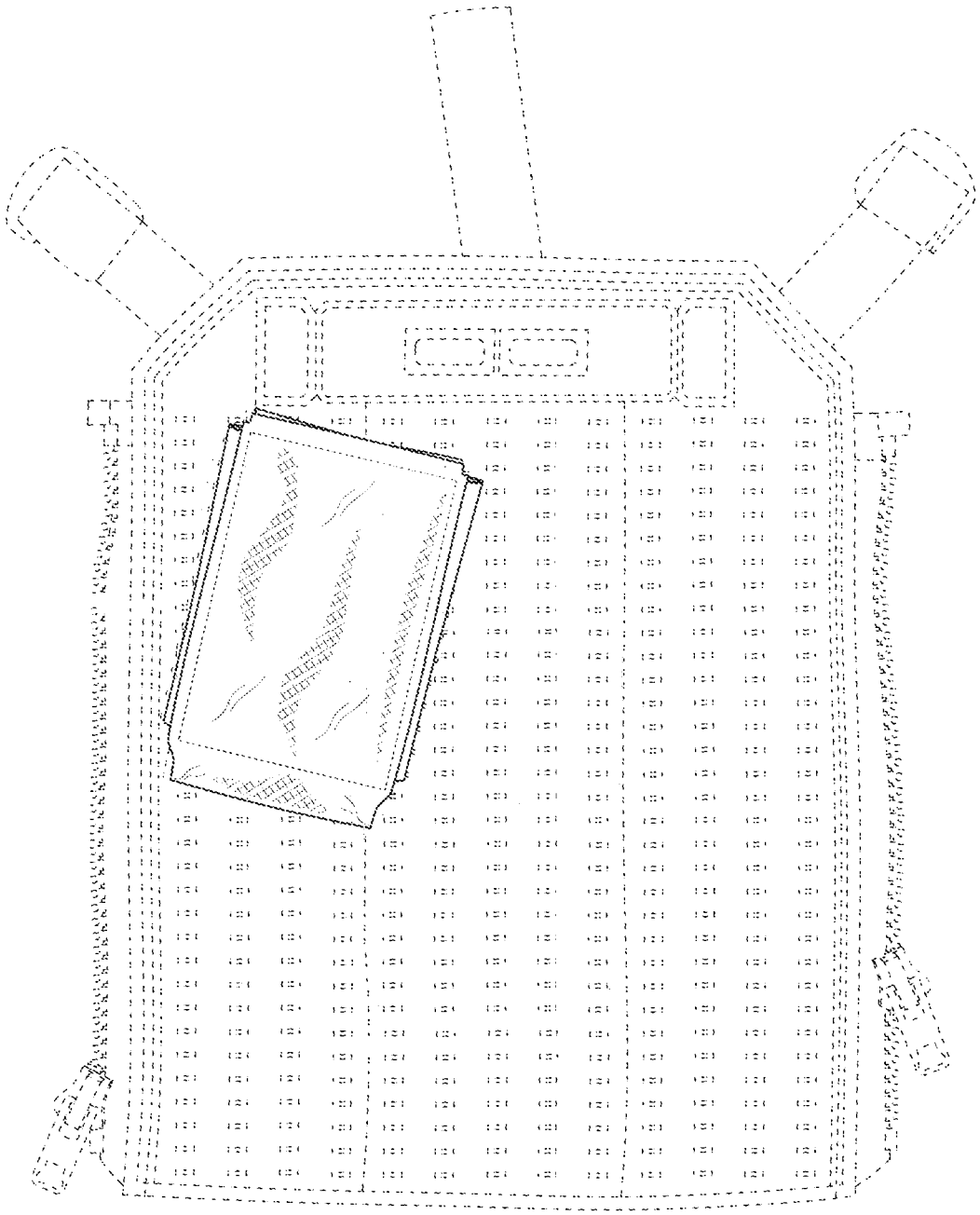
FIG. 5 is another schematic view thereof.
Figure 6:
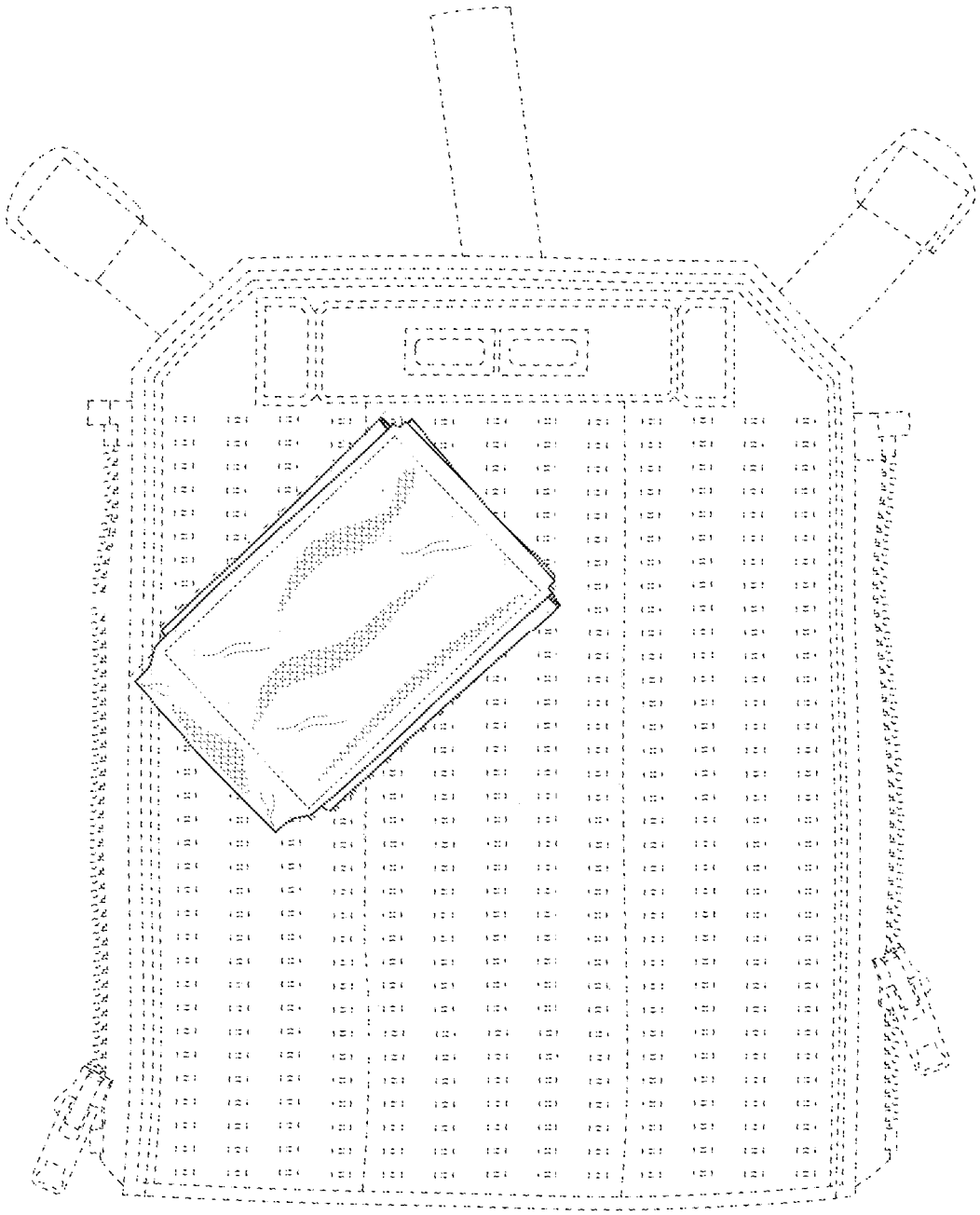
FIG. 6 is another schematic view thereof.
Figure 7:
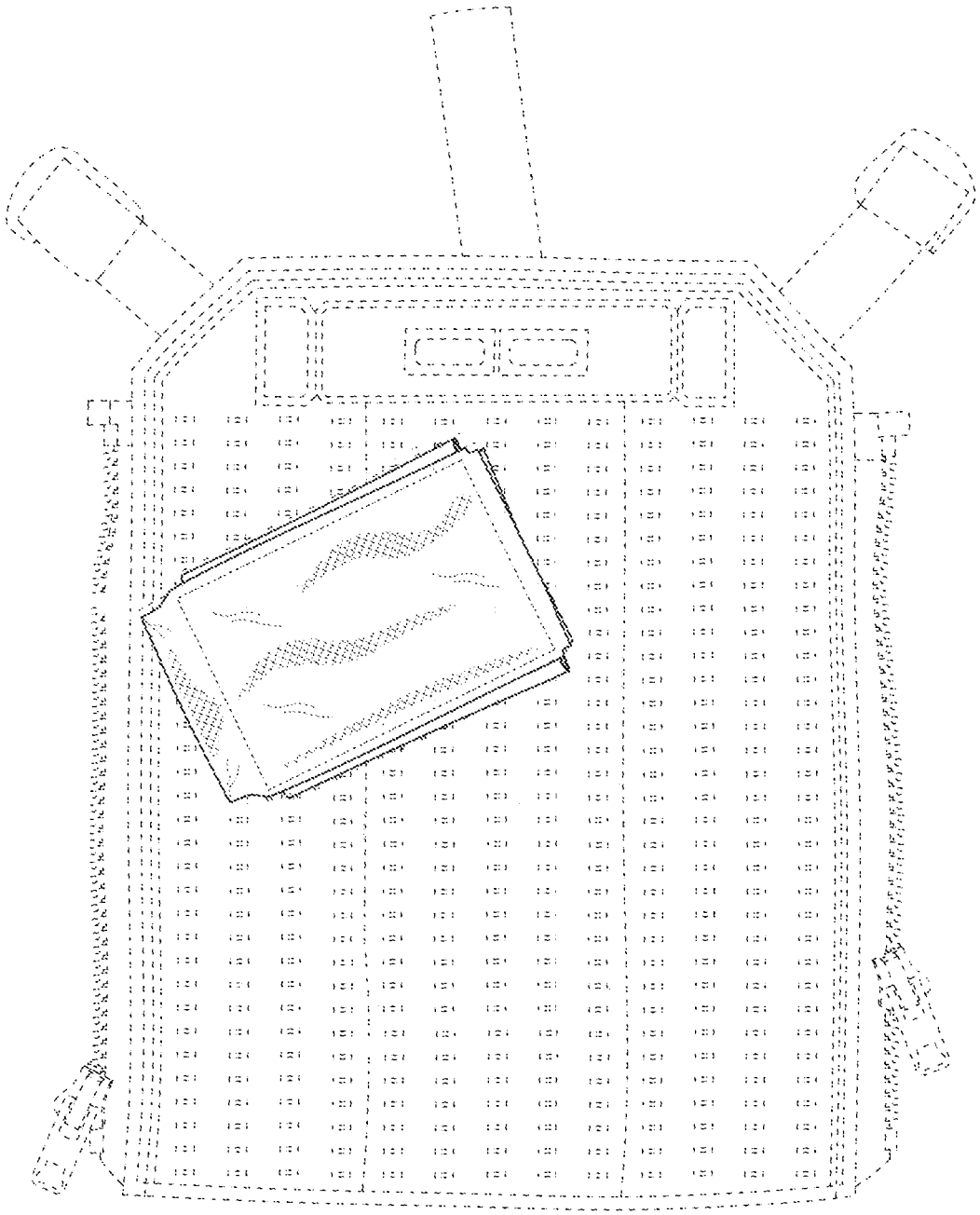
FIG. 7 is another schematic view thereof.
Figure 8:
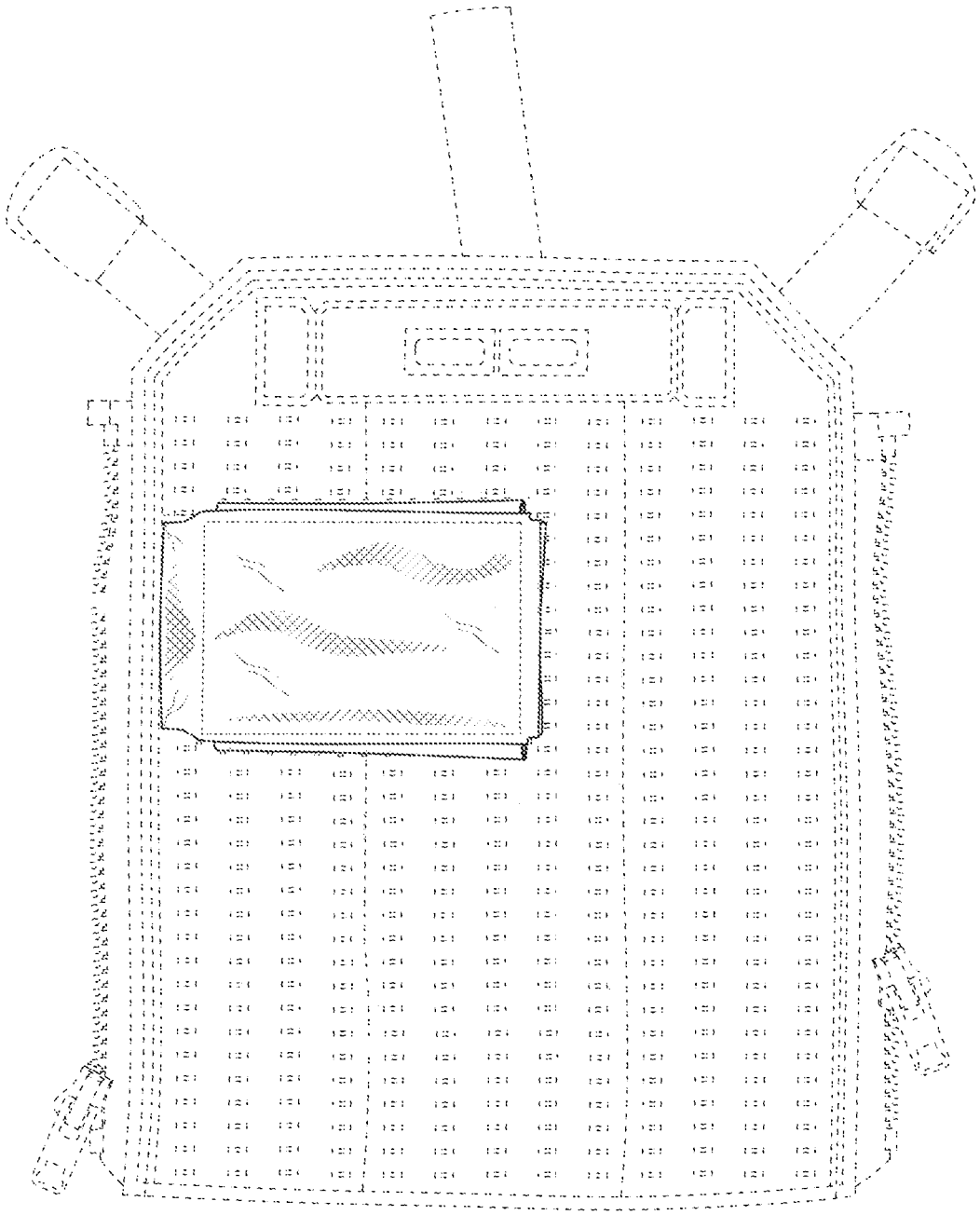
FIG. 8 is another schematic view thereof.
Figure 9:
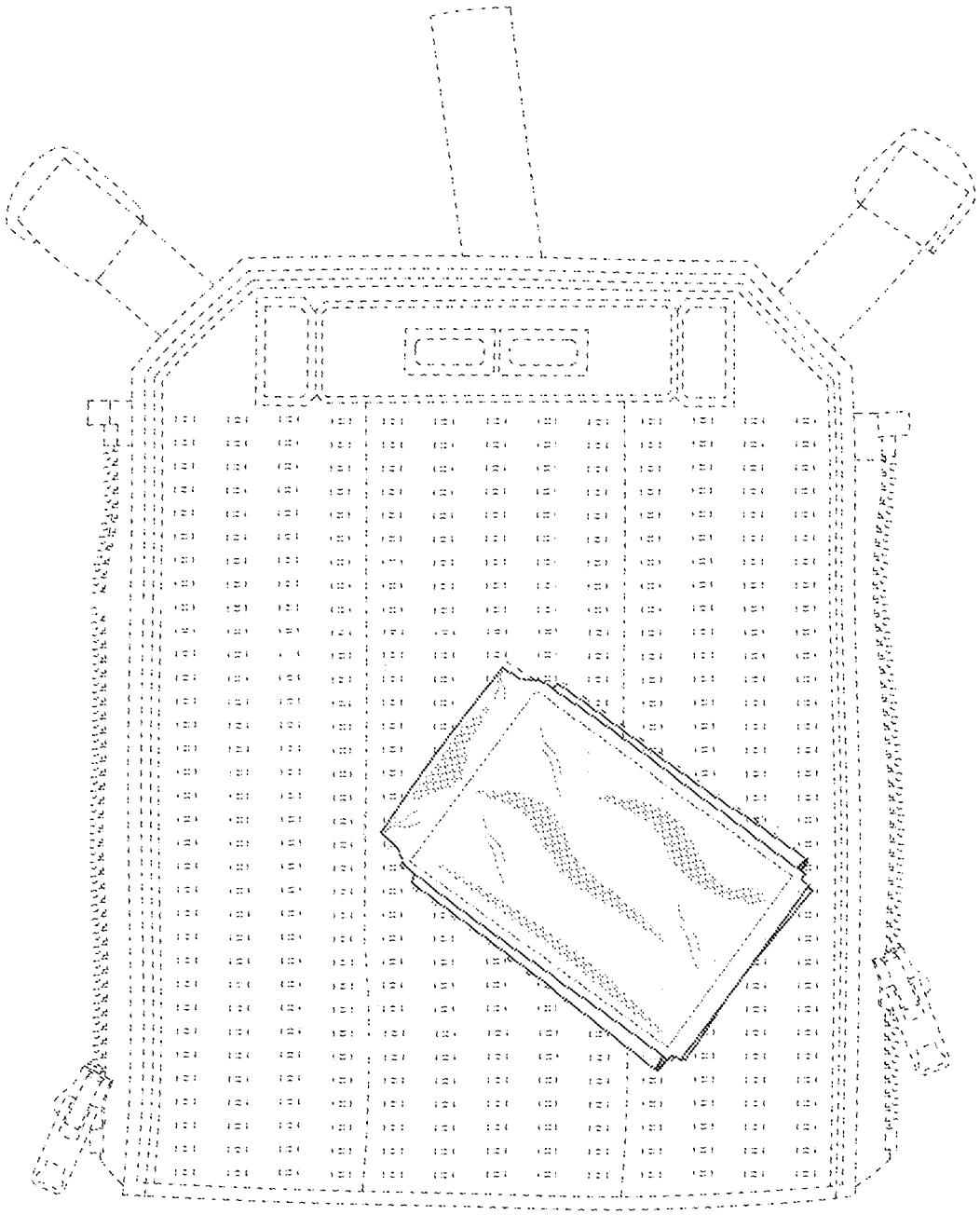
FIG. 9 is another schematic view thereof.
Figure 10:
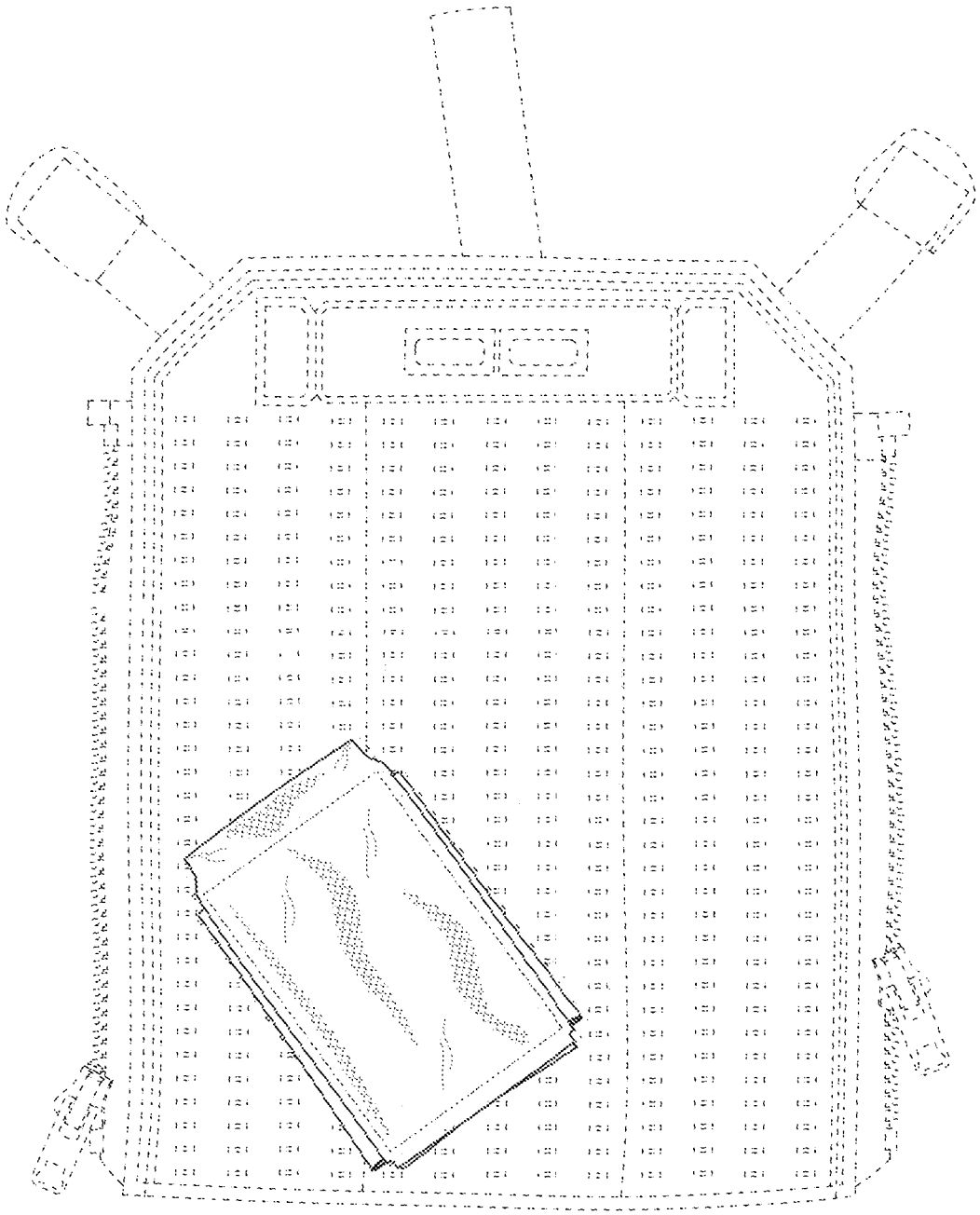
FIG. 10 is another schematic view thereof.
Figure 11:
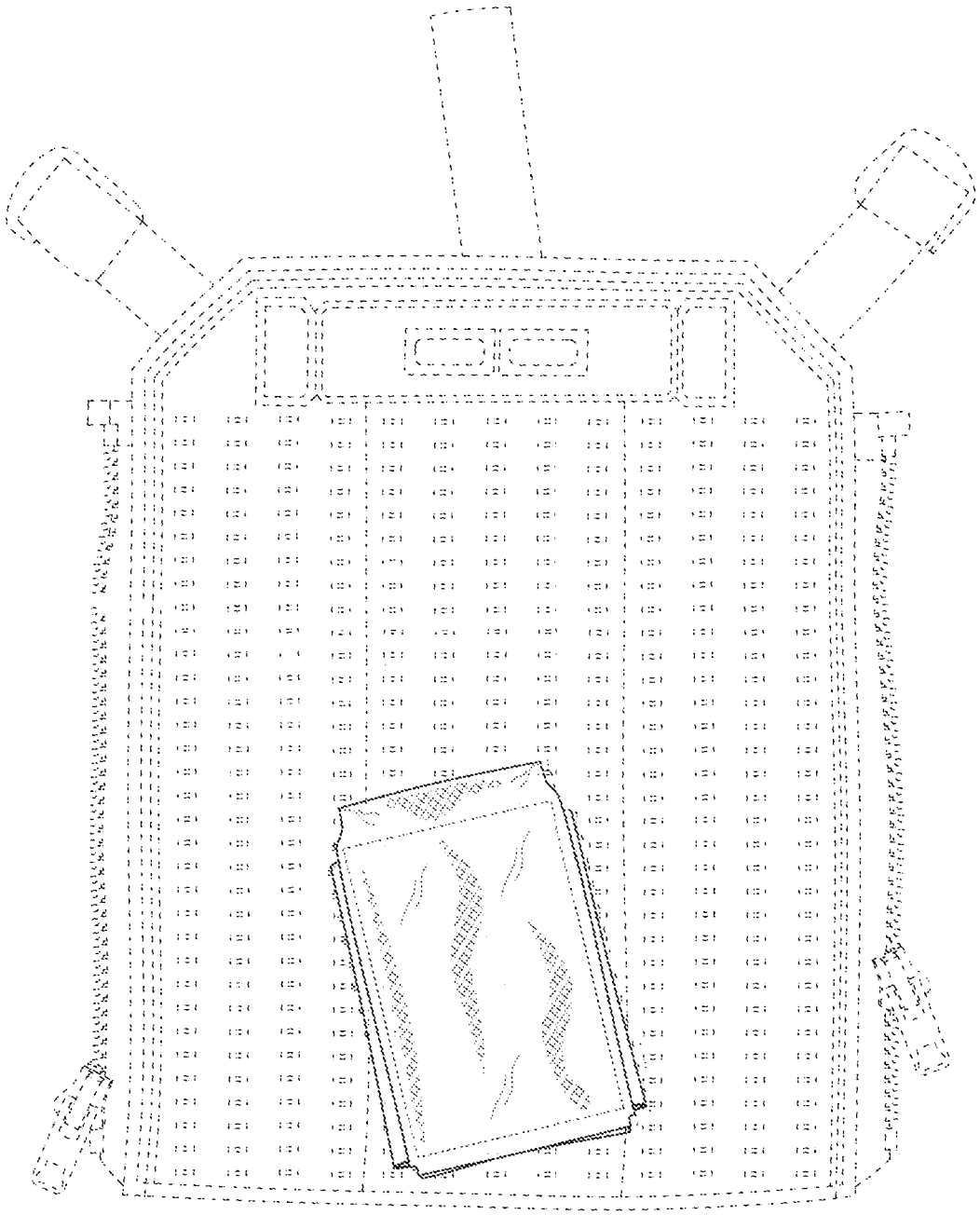
FIG. 11 is another schematic view thereof.
Figure 12:
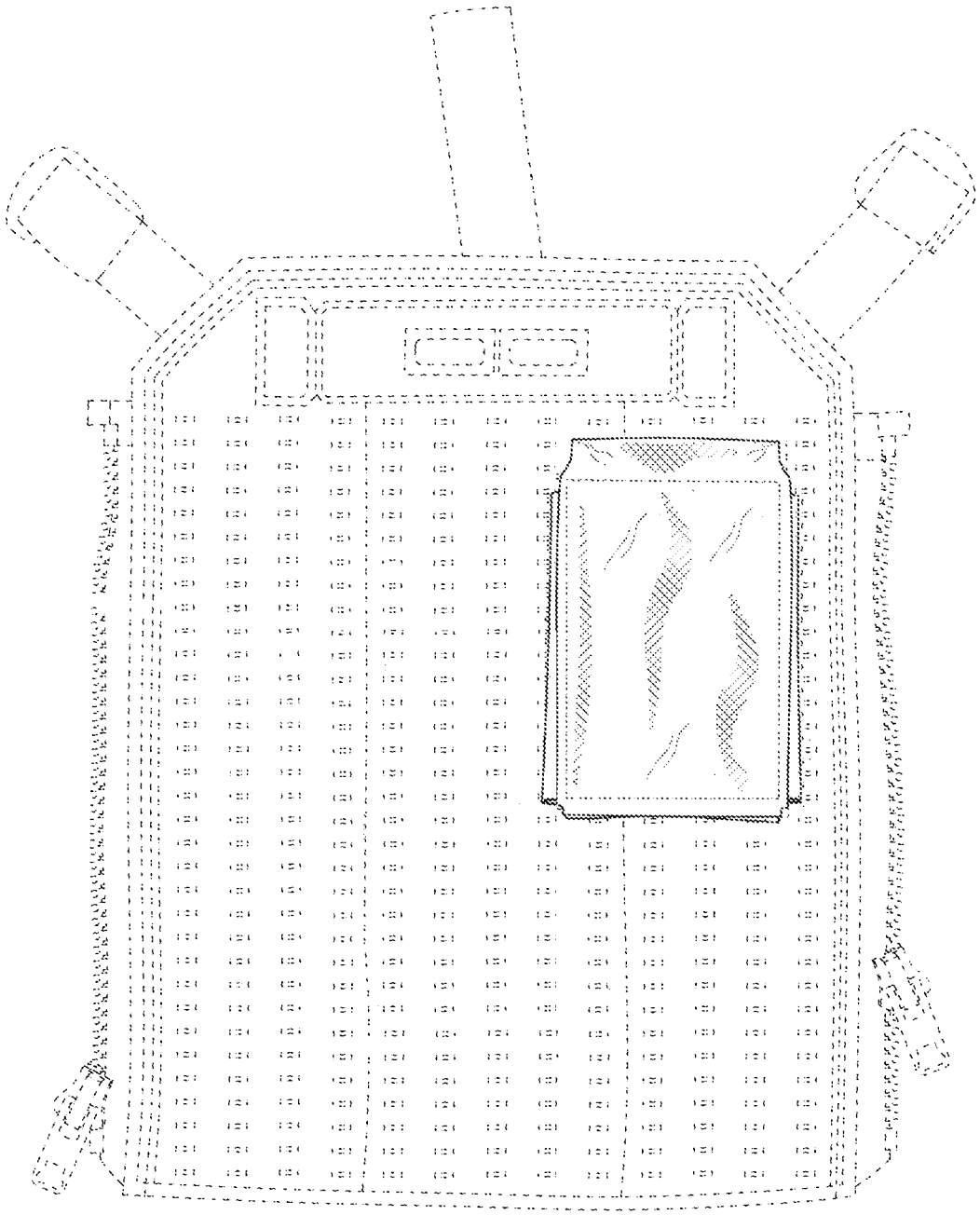
FIG. 12 is another schematic view thereof.
Figure 13:
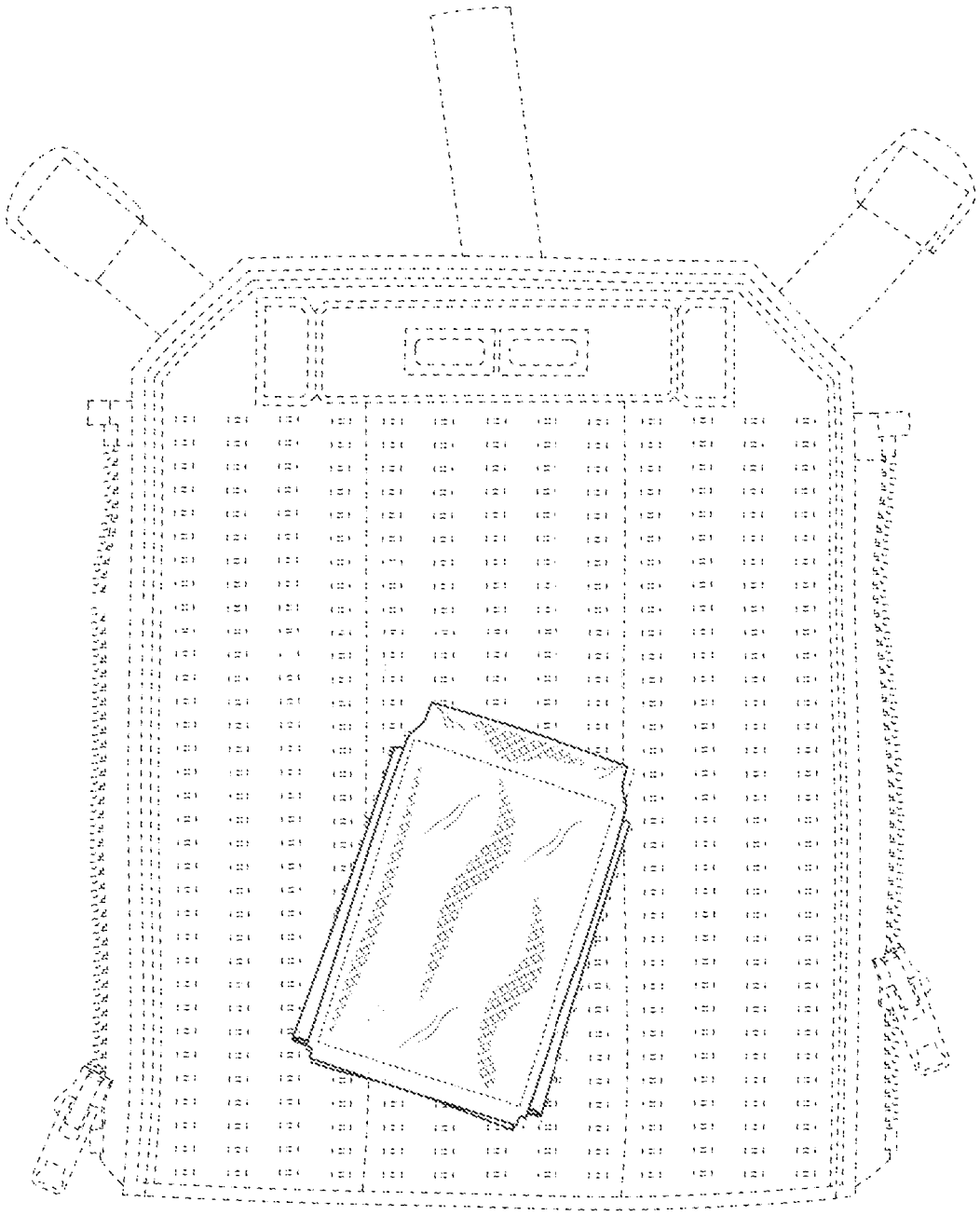
FIG. 13 is another schematic view thereof.
Figure 14:
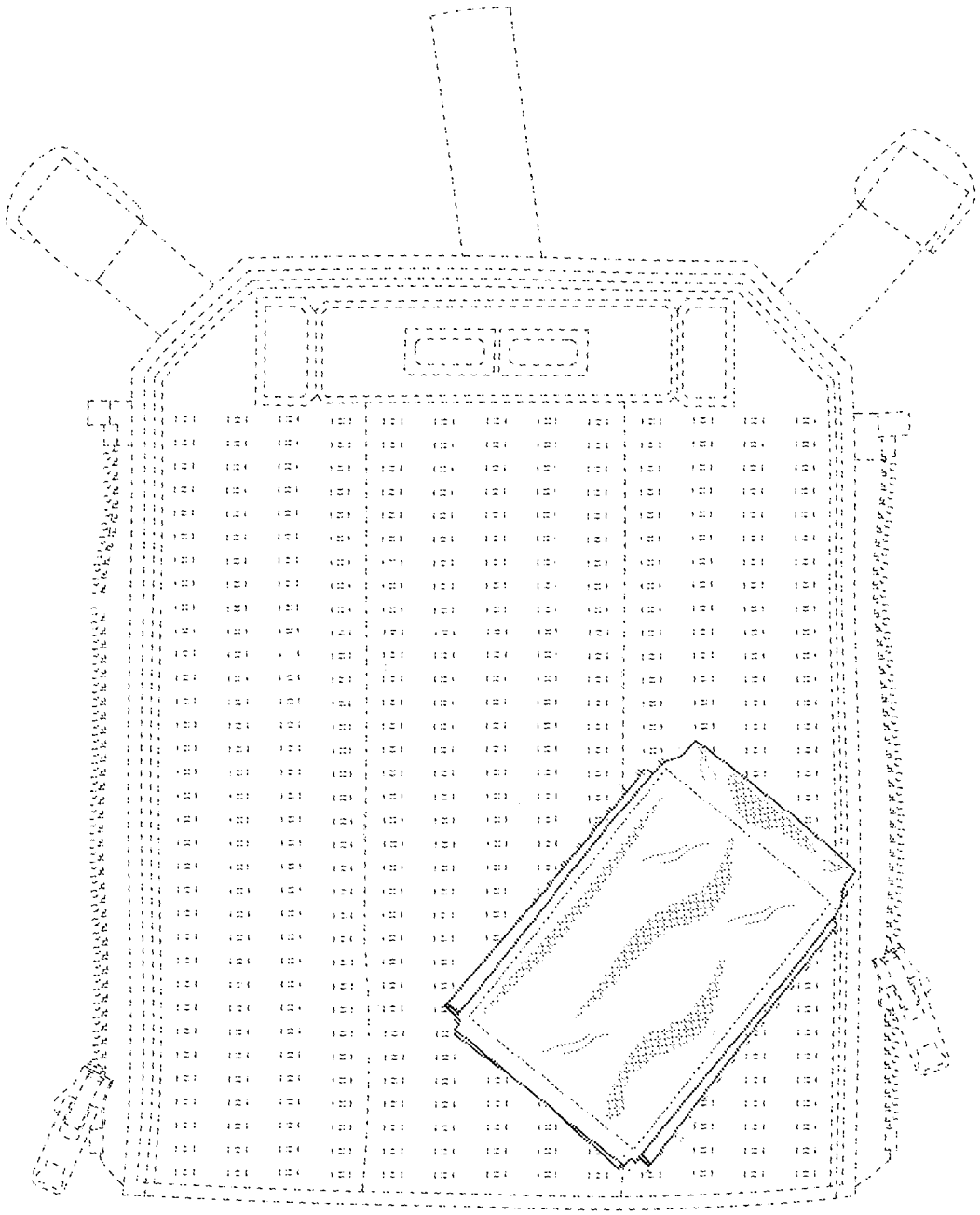
FIG. 14 is another schematic view thereof.
Figure 15:
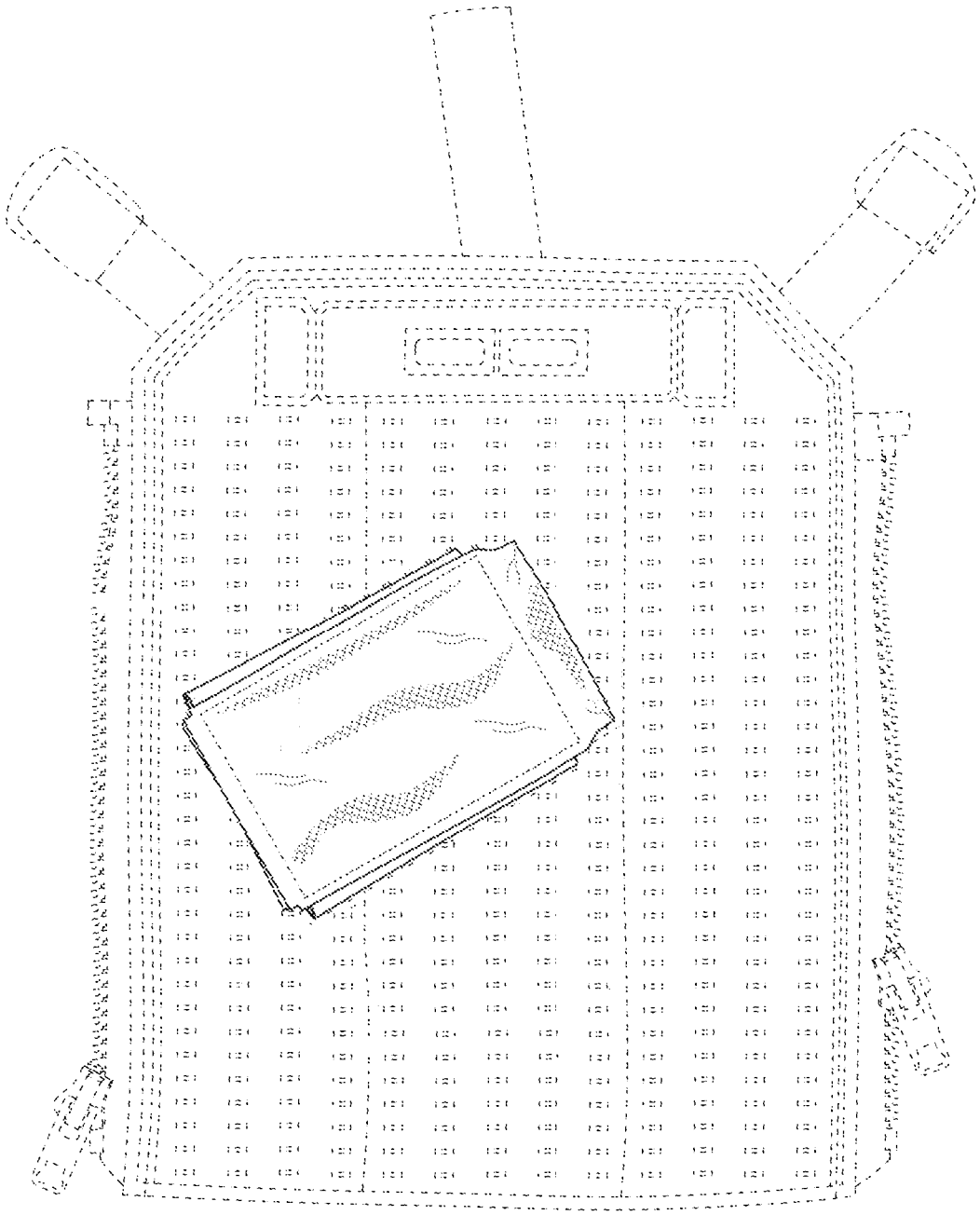
FIG. 15 is another schematic view thereof.
Figure 16:
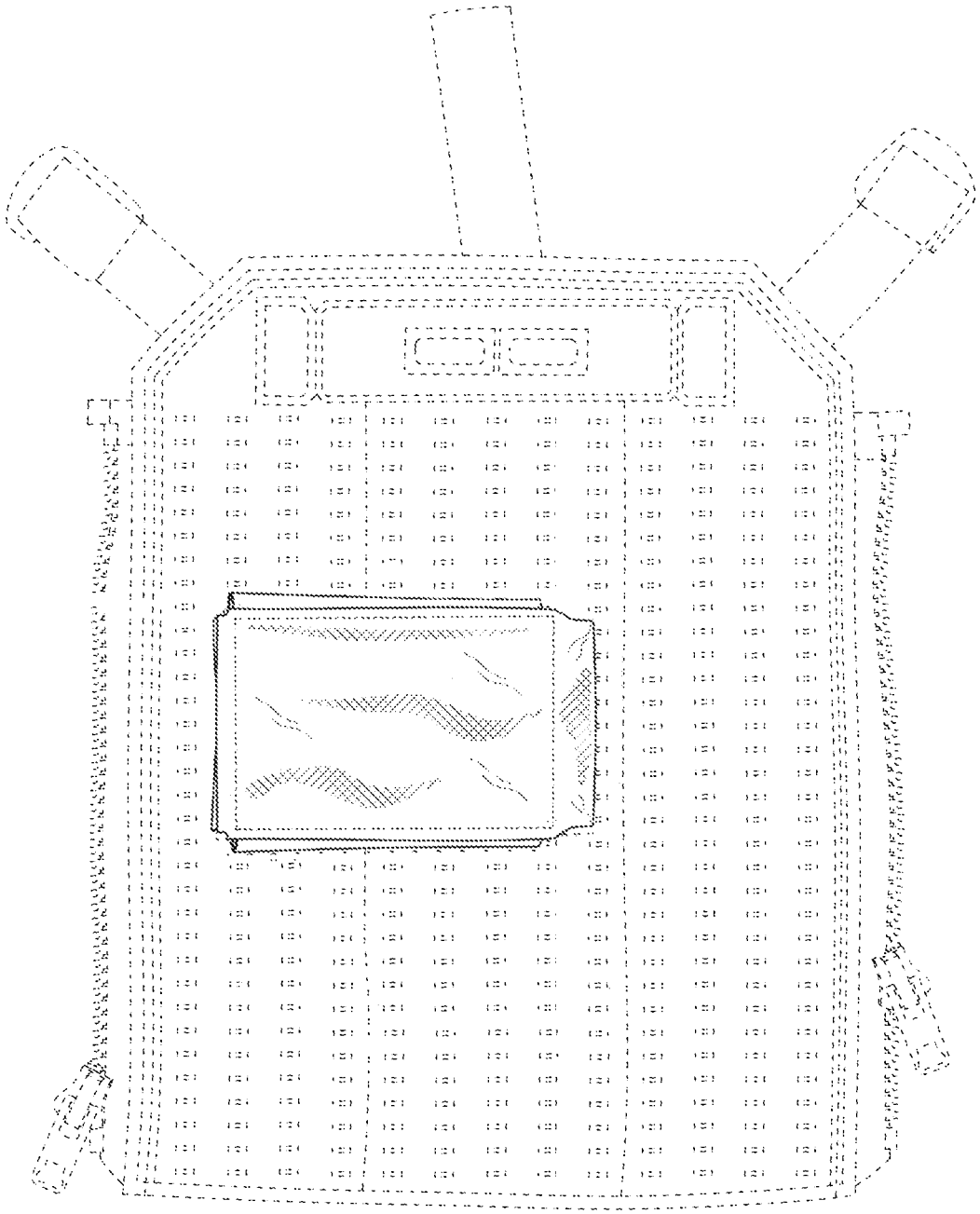
FIG. 16 is another schematic view thereof.

Referring to FIGS. 1 through 3, FIG. 1 illustrates a modular load attachment system according to an embodiment of the present invention, comprising a load bearing garment 10, such as a plate carrier, having a plurality of slots or portals 16 with accessories 12, 14 bound thereto with a line 18 which may be, for example, a shoelace.

As shown in FIG. 2, an accessory 12 may be bound to the load bearing garment 10 by drawing the line 18 through portals 16 on the accessory 12 and the load bearing garment 10 with a needle 20.

FIG. 3 illustrates the attachment configuration of the accessory 12 on the garment 10, wherein the line 18 is passed through alternating portals 16 on each, e.g., from a portal 16 on the garment 10 to a portal 16 on the accessory 12 and back to another portal 16 on the garment 10. The slots 16 are present in rows with apertures sufficiently small that the accessory 12, 14 may be aligned at any angle.

FIGS. 4 through 16 show an accessory 12 of a modular load attachment system according to an embodiment of the present invention, shown mounted on a load bearing garment 10 in a variety of orientations and positions. The inventive system is highly versatile, enabling one to mount the accessory in virtually any orientation and position.

It should be understood, of course, that the foregoing relates to exemplary embodiments of the invention and that modifications may be made without departing from the spirit and scope of the invention as set forth in the following claims.

What is claimed is:

1. A modular attachment load system, comprising:

a substrate having a first plurality of spaced apart hourglass-shaped apertures;

a binding material;

an article having a second plurality of spaced apart hourglass-shaped apertures aligned with a portion of the first plurality of spaced apart hourglass-shaped apertures; and a needle configured to attach to the binding material and to alternately draw the binding material through the first plurality of spaced apart hourglass-shaped apertures and the second plurality of spaced apart hourglass-shaped apertures;

wherein the first plurality of spaced apart hourglass-shaped apertures and the second plurality of spaced apart hourglass-shaped apertures are operative to bind the article to the substrate horizontally, vertically, and at any angle therebetween.

2. The modular attachment load system of claim 1, wherein the substrate is selected from the group consisting of: garments, equipment, plate carrier, cummerbunds, belts, pants, t-shirts, helmet covers, jackets, magazine pouches, boots, shoes, vests, backpacks, rucksacks, and any combination thereof.

3. The modular attachment load system of claim 1, wherein the binding material is selected from the group consisting of: a cord, a shoelace, a string, a 550 cord, a dental floss, a thread, and a mixture thereof.

4. A method of mounting an article of a modular attachment load system, comprising:

providing a modular attachment load system comprising:

(a) a substrate having a first plurality of spaced apart hourglass-shaped apertures;

(b) a binding material; and (c) an article having a second plurality of spaced apart hourglass-shaped apertures aligned with a portion of the first plurality of spaced apart hourglass-shaped apertures;

attaching the binding material to a needle; and drawing the needle and the binding material alternately through the first plurality of spaced apart hourglass-shaped apertures and the second plurality of spaced apart hourglass-shaped apertures to bind the article to the substrate horizontally, vertically, or at any angle therebetween.

5. The method of claim 4, further comprising, before drawing the needle and the binding material through, orienting the article on the substrate in a position selected from the group consisting of vertically, horizontally, and any angle therebetween.

* * * * *